US008898903B2

(12) United States Patent
Nagata et al.

(10) Patent No.: US 8,898,903 B2
(45) Date of Patent: Dec. 2, 2014

(54) FORM ROLLING METHOD FOR INVOLUTE GEAR

(75) Inventors: Eiri Nagata, Toyoake (JP); Nobuaki Kurita, Yatomi (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 132 days.

(21) Appl. No.: 13/157,597

(22) Filed: Jun. 10, 2011

(65) Prior Publication Data

US 2011/0302783 A1 Dec. 15, 2011

(30) Foreign Application Priority Data

Jun. 15, 2010 (JP) ..... 2010-136469

(51) Int. Cl.
*B21K 1/30* (2006.01)
*B21H 5/02* (2006.01)

(52) U.S. Cl.
CPC ..... *B21H 5/02* (2013.01)
USPC ..... 29/893.32; 29/893; 29/893.3

(58) Field of Classification Search
CPC ..... B23F 17/00; B23P 6/00; B23P 15/14; B23H 5/02; B21K 1/30
USPC ..... 29/893, 893.3, 893.32, 893.34, 893.35, 29/557
See application file for complete search history.

(56) References Cited

FOREIGN PATENT DOCUMENTS

| | | | |
|---|---|---|---|
| CN | 1151917 | A | 6/1997 |
| DE | 915 328 | C | 7/1954 |
| DE | 16 02 670 | A1 | 12/1970 |
| GB | 1 245 344 | | 9/1971 |
| JP | 1-37800 | | 11/1989 |
| JP | 5-53748 | U | 7/1993 |
| JP | 2003-340542 | | 12/2003 |
| JP | 2006-917 | A | 1/2006 |
| JP | 2008-229665 | A | 10/2008 |
| SU | 1516208 | A1 | 10/1989 |

OTHER PUBLICATIONS

Extended European Search Report issued on Oct. 10, 2011 in the corresponding European Application No. 11169743.9.
Combined Office Action and Search Report issued Aug. 13, 2013 in Chinese Patent Application No. 201110165756.8 with English language translation.
Japanese Office Action issued Apr. 3, 2014 in Patent Application No. 2010-136469 with English Translation.

*Primary Examiner* — Ryan J Walters
(74) *Attorney, Agent, or Firm* — Oblon, Spivak, McClelland, Maier & Neustadt, L.L.P.

(57) ABSTRACT

A form rolling method for an involute gear, which includes a work piece including a cylindrical outer peripheral surface having a predetermined radius, and a round die with an involute tooth profile including an addendum pitch corresponding to a pitch defined by dividing a length of an outer circumference of the work piece by number of teeth of the involute gear. The round die is pressed to the work piece while rotating when form rolling the involuete gear.

5 Claims, 3 Drawing Sheets

FORM ROLLING METHOD FOR INVOLUTE GEAR

CROSS REFERENCE TO RELATED APPLICATIONS

This application is based on and claims priority under 35 U.S.C. §119 to Japanese Patent Application 2010-136469, filed on Jun. 15, 2010, the entire content of which is incorporated herein by reference.

TECHNICAL FIELD

This disclosure generally relates to a form rolling method for an involute gear.

BACKGROUND DISCUSSION

According to a known method for forming a gear, a die on which a predetermined tooth profile is formed is pressed to a cylindrical blank to form a gear with a predetermined configuration. In those circumstances, for example, a round die for form rolling having a tooth profile which is engageable with a gear to be manufactured is applied. Generally, two round dies for form rolling are rotated and are moved to be close to a work piece to press the dies to the work piece. The round dies for form rolling are gradually pressed to move to a final position for forming a gear.

In a case where a gear is formed by using a round die for form rolling, first, an addendum portion of a tooth of the round die for form rolling comes in contact with a surface of a work piece. Intermittently pressed indentations are formed on the surface of the work piece by the contact of the addendum portion of the tooth of the round die. By gradually pressing the round die for form rolling to the work piece, a tooth (teeth) of the round die for form rolling thrusts into the work piece to form a bottom land portion of the gear. On the other hand, at a portion adjacent to the bottomland portion, a blank of the work piece is bulged to form a tooth portion of the gear. A desired configuration of the gear is formed when the round die for form rolling is pressed to a predetermined position relative to the work piece.

FIG. 2 shows a state where a die 20 starts contacting a work piece 10 (i.e., contacting state of the die 20) in a manufacturing process for a known involute gear. The die 20 is rotated by an actuation of a driving mechanism. The work piece 10 is driven by the die 20. Generally, another die 20 is arranged at an opposite side of the work piece 10, and the work piece 10 is pressed by a pair of the dies 20. In a state shown in FIG. 2, an addendum portion 21 of the die 20 presses into the work piece 10 to form an indentation 11. By moving an axis X2 of the die 20 to an axis X1 of the work piece 10 while rotating the die 20, the addendum portions 21 of the die 20 are gradually and consecutively pressed into the indentation 11 so that a dimension of the indentation 11 are enlarged broader and deeper. A base material of the work piece 10 positioned at the indentation 11 is bulged at both sides of the indentation 11 to form gear teeth.

FIG. 3 shows a mid-way state during a form rolling where the addendum portion 21 of the die 20 thrusts into, or presses into the work piece 10 to some extent. The die 20 moves to be closer to the work piece 10 while rotating, presses into the work piece 10 to form the indentation 11, and the addendum portion 21 of the die 20 simultaneously presses the work piece 10 in a radial direction to form the indentation 11 to be deeper and in a circumferential direction to expand the indentation 11 to be broader when the die 20 moves to be away from the work piece 10 so that adjacent portions of the indentation 11 are plastically deformed to form gear teeth.

FIG. 4 shows a state where the pressing of the die 20 into the work piece 10 is completed. Each tooth 12 of a gear W formed by the form rolling is engaged with teeth 22 of the die 20 without a backlash. In those circumstances, a tooth depth of the gear W corresponds to a tooth depth of the die 20. The gear W includes a base circle C1 having a radius rg1 whereas the die 20 includes a base circle C2 having a radius rg2. Each of the teeth 12 includes an involute tooth profile, and a pitch circle Cp2 of the die 20 is tangent to a pitch circle Cp1 of the gear W at a pitch point p. The pitch circle Cp1 has a radius rp1, and the pitch circle Cp2 has a radius rp2. The pitch point p corresponds to a point of intersection of a line connecting a center X1 of the gear W, a center X2 of the die 20, a common tangent L of the base circle C1 of the gear W, and the base circle C2 of the die 20. An angle formed by the line connecting the center X1 of the gear W and the center X2 of the die 20 and a perpendicular line drawn from the center X1 of the gear W, or the center X2 of the die 20, to the common tangent L, corresponds to a working pressure angle $\alpha w$. The working pressure angle $\alpha w$ is defined when meshing two involute gears, and thus, the working pressure angle is varied when a distance between centers of the gears is varied.

On the other hand, each gear includes a pressure angle, which is defined when a pitch point overlaps a reference circle of the gear. The reference circle is defined for each gear or each die as a reference for determining parameters for designing gears or dies including the number of teeth, a module, a pressure angle, a helix angle, an addendum modification coefficient, or the like. Hereinafter, "pressure angle" indicates the pressure angle defined on the reference circle.

FIG. 5 is an explanatory view showing changes in configuration of the work piece 10. A surface of the work piece 10 before a form rolling process is indicated as d0 in FIG. 5. A portion indicated as a region A2 is pressed by the form rolling, and a base material moved from the pressed region A2 is assumed to have a volume of region A1 to form an addendum portion. Further, FIG. 5 illustrates addendum circle d1 and dedendum circle d2.

Conventionally, a gear configuration of the die 20 is designed on the basis of a configuration of the gear W to be manufactured. For example, specifications for forming the die 20 includes the number of teeth, a module, a pressure angle, a helix angle, an addendum modification coefficient, or the like. In those circumstances, generally, a module, a pressure angle, and a helix angle of the gear W are most likely applied as they are for determining the configuration of the die 20, and an addendum modification coefficient is fine-tuned as necessity arises. Thus, man-hours and labor for designing the die 20 are reduced, and the die 20 for forming the gear W with a desired configuration is readily attained. Generally, a diameter of the die 20 differs from a diameter of the gear W and the number of the gear tooth of the die 20 is assumed to be greater than the number of the gear tooth of the gear W.

In order to make the involute gears engage each other appropriately, base pitches of the respective involute gears have to accord to each other. The base pitch corresponds to a pitch measured along a common perpendicular between tooth profiles of a particular tooth and another tooth adjacent to the particular tooth. Namely, even if configurations of teeth and the number of teeth of the both gears differ from each other, the gears engage with each other appropriately as long as the feed distances between the teeth are the same. The base pitch P is generally defined as follows using a module m and a pressure angle $\alpha$ of the gear.

$$P=\pi \cdot m \cdot \cos \alpha \quad [1]$$

Thus, conventionally, the module m and the pressure angle α of the die 20 can differ from those of the gear W. However, settings of degrees of the module m and the pressure angle α of the die 20 relative to the module and the pressure angle of the gear W, are not utilized in known methods and constructions.

According to the known form rolling method, a configuration of a die is designed assuming a meshed state of the die and a gear when the form rolling is completed. Accordingly, for example, when forming a bottom land portion of the gear by pressing the die into a work piece, there is a drawback that a contacting position of a tooth of the die to the work piece fluctuates in a circumferential direction of the work piece with each contact of the tooth. In other words, in a state where the gear is completely formed, the gear and the die are tangent to each other at a respective pitch circle to be appropriately engaged. Generally, a pitch on a reference circle of the die and a pitch on the pitch circle are considered for designing dies, however, an addendum pitch (i.e., pitch between addendum portions of adjacent teeth) is not particularly considered when designing the dies. Thus, positions of indentations formed on the work piece at an initial stage of the form rolling process is not stabilized. Further, according to circumstances, there is a drawback that each time an addendum portion of a die contacts a work piece, a position of an indentation deviates in a circumferential direction. In those circumstances, in addition to a configuration of the indentation portion being formed in an inappropriate shape, a precision of a gear is decreased and a gear having inferior mechanical characteristics may be formed because a base material of the work piece is unnecessarily plastically deformed.

In order to solve the foregoing drawbacks, for example, JPH1-37800U (i.e., referred to as Patent reference 1) discloses a die provided with processing teeth including a contacting portion, a mid finishing portion, a finishing portion, and a run-off portion, in order. With the construction of the die disclosed in the Patent reference 1, configurations of an addendum portion of each portion and a distance between teeth portions are changed. Thus, when pressing the die into the work piece, the addendum portion of the die can be pressed to a desired position to form an indentation in an appropriate configuration. Other than the disclosure in the Patent reference 1, for example, according to a known method, in response to a distance between an axial center of a die and an axial center of a work piece is shortened, dies are changed to perform the form rolling. According to this method, although a gear is formed to some extent with precision, changing operations of dies require man-hours and labors.

As explained above, in known methods, the pressed positions of the die change when performing a form rolling using a round die, and configurations of teeth of the die are configured to change during the form rolling process in order to compensate for the changes of the pressed positions of the die. Accordingly, manufacturing operations of the gear are assumed to be complicated and man-hours and manufacturing costs are increased.

A need thus exists for a form rolling method for an involute gear which is not susceptible to the drawback mentioned above.

SUMMARY

In light of the foregoing, the disclosure provides a form rolling method for an involute gear, which includes a work piece including a cylindrical outer peripheral surface having a predetermined radius, and a round die with an involute tooth profile including an addendum pitch corresponding to a pitch defined by dividing a length of an outer circumference of the work piece by number of teeth of the involute gear. The round die is pressed to the work piece while rotating when form rolling the involute gear.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments of a form rolling method for an involute gear will be explained with reference to illustrations of drawing figures as follows.

A form rolling method for an involute gear according to the embodiments relates to a method for forming a gear which excels in mechanical characteristics with high precision by optimizing a contact of a round die (i.e., hereinafter referred to as a die) relative to a work piece when form rolling an involute gear (i.e., hereinafter referred to as a gear) using the work piece including a cylindrical configuration, and further by appropriately pressing the die into the work piece thereafter.

Figure 1:
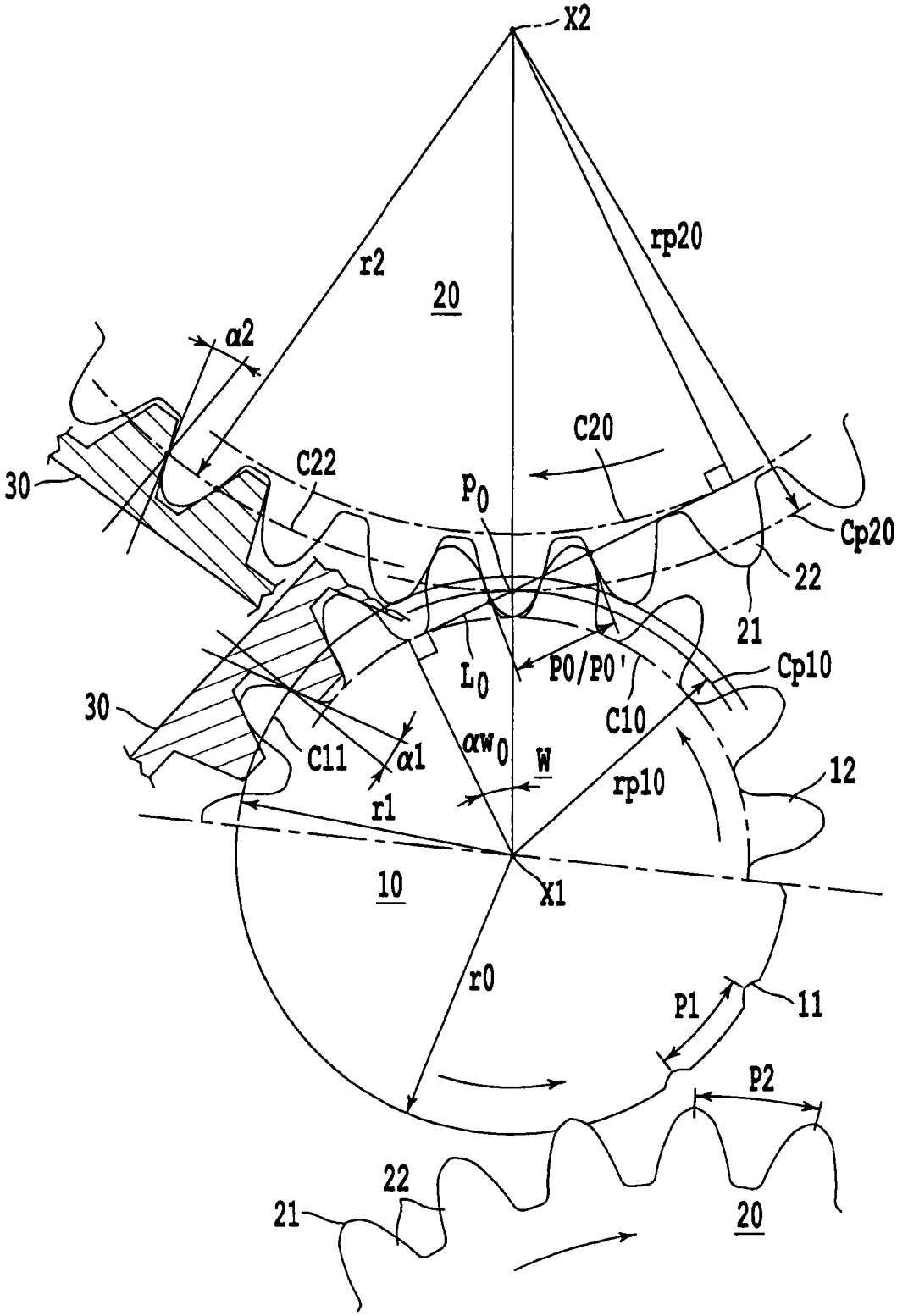
FIG. 1 is an explanatory view illustrating constructions of a work piece and a round die during a form rolling disclosed here.
Figure 2:
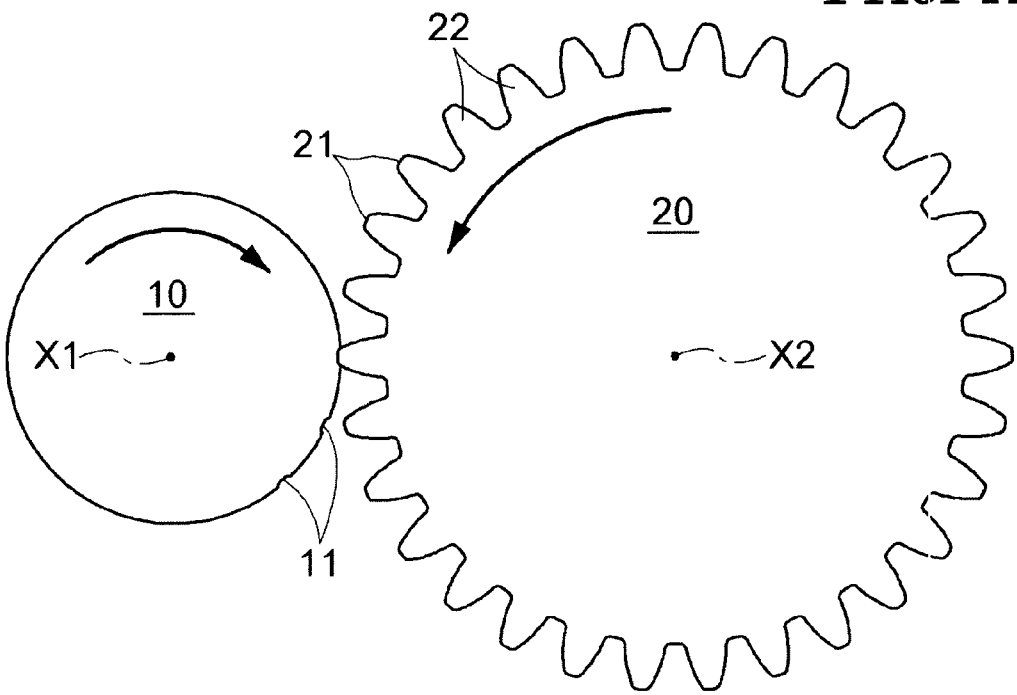
F I G. 2 Prior Art
FIG. 2 is an explanatory view showing an initial state of the work piece and the die during a form rolling process according to a known method.
Figure 3:
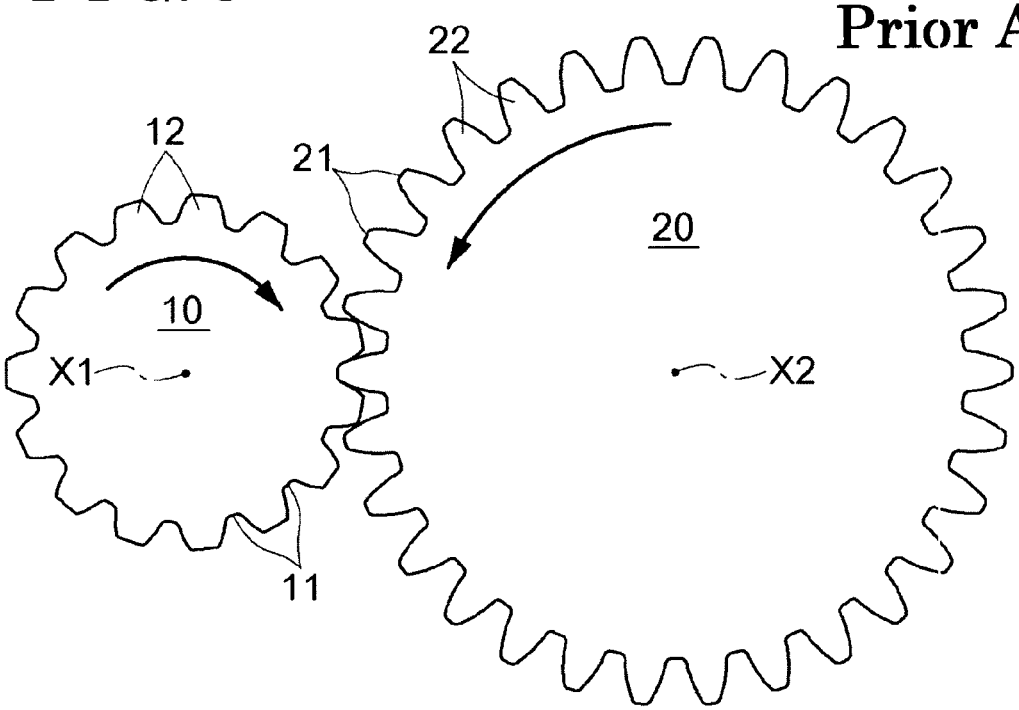
F I G. 3 Prior Art
FIG. 3 is an explanatory view showing a middle period state of the work piece and the die during the form rolling process according to the known method.
Figure 4:
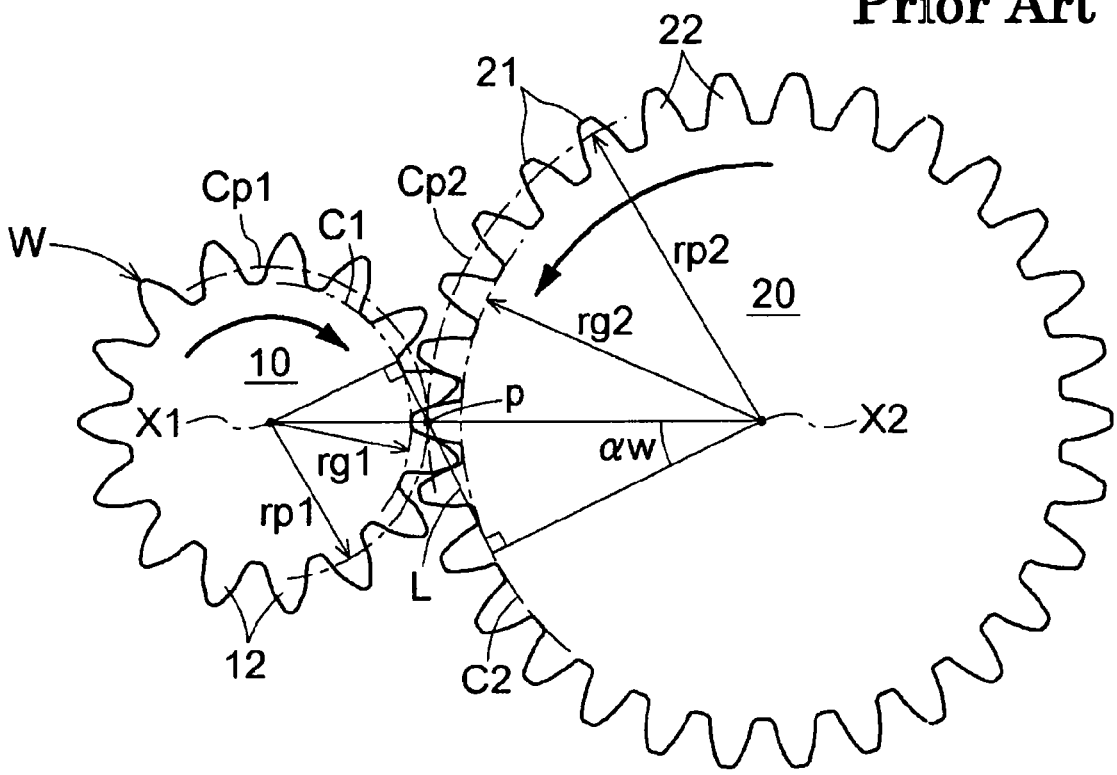
FIG. 4 Prior Art
FIG. 4 is an explanatory view showing a late period state of the work piece and the die during the form rolling process according to the known method.
Figure 5:
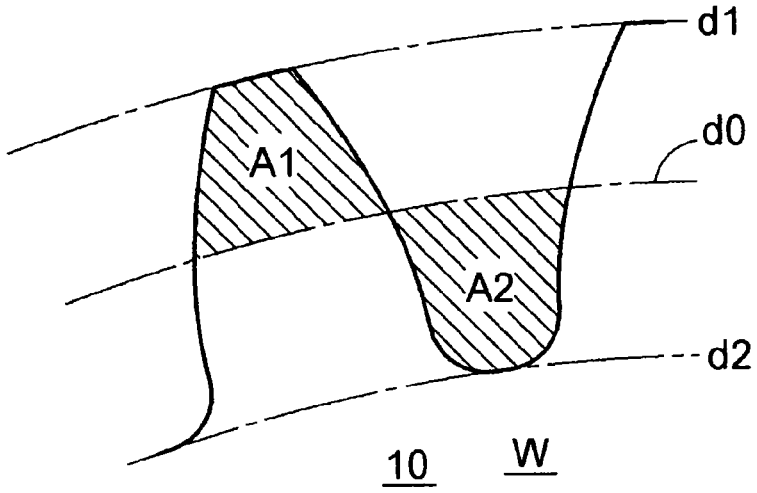
FIG. 5 Prior Art
FIG. 5 is an explanatory view showing changes in configuration of the work piece according to the known method.

As shown in FIG. 1, a form rolling of a work piece 10 is processed using a die 20. A bottom-half in FIG. 1 shows a state where the die 20 starts pressing the work piece 10. A top-half in FIG. 1 shows a state where the form rolling process is completed. A pitch P1 of an indentation 11 formed on the work piece 10 is obtained by the following formula:

$$P1=2\pi \cdot r0/Z1 \quad [2]$$

where: an initial radius of the work piece 10 is defined as an initial radius r0 and the number of teeth is defined as the number of teeth Z1.

The work piece 10 is rotatably supported by a form rolling apparatus to rotatable about an axis X1. The work piece 10 may be supported to drive itself or may be supported to freely rotate. According to the construction disclosed in the embodiments, because the indentation 11 is formed at an appropriate position of the work piece 10 by the die 20, and an addendum portion 21 of the die 20 does not unnecessarily rotate the work piece 10 during the form rolling process, the construction that the work piece 10 is supported to freely rotate is sufficient.

Various specifications, for example, a first module m1, a first pressure angle α1, and the number Z1 of gear teeth are predetermined for a gear W to be formed. The first module m1 is obtained by the following formula:

$$m1=2\cdot r1/Z1 \quad [3]$$

where: a radius of a gear reference circle C11 of the gear W is defined as a radius r1, and the number of gear teeth of the gear W is defined as the gear teeth number Z1.

Based on equation [1], where a circular pitch on the reference circle C11 is defined as $\pi\cdot m1$, and a pressure angle is defined as first pressure angle $\alpha 1$, a base pitch P0 is obtained by the following formula:

$$P0=\pi\cdot m1\cdot\cos\alpha 1 \quad [4]$$

On the other hand, a configuration of the die 20 is determined on the basis of the specifications of the gear W to be formed. According to the embodiments, an addendum pitch (i.e., pitch between addendum portions of adjacent teeth) P2 of the die 20 is determined to be the same as the pitch P1 between the indentations 11. According to the foregoing constructions, the indentation 11 is formed at an optimum position by an initial pressing operation. Once the indentation 11 is formed, the addendum portion 21 is guided by the indentation 11 when the next addendum portion comes in contact with the work piece 10.

After the addendum pitch P2 is determined, a second module m2 and a second pressure angle $\alpha 2$ are determined. A base pitch P0' of the die 20 is determined to satisfy equation [4]. The base pitch P0' of the die 20 is determined to be the same as the base pitch P0 of the gear W. Thus, where a circular pitch on a die reference circle C22 having a radius r2, is defined as $\pi\cdot m2$, and the second pressure angle is defined as the second pressure angle $\alpha 2$, the base pitch P0' of the die 20 is defined as follows:

$$P0'=\pi\cdot m2\cdot\cos\alpha 2 \quad [5]$$

Namely, the following relationship is established:

$$m1\cdot\cos\alpha 1=m2\cdot\cos\alpha 2 \quad [6]$$

According to the construction of the embodiments, the indentations 11 need to be securely formed on the work piece 10 by the addendum portion 21 of the die 20. Thus, the addendum portion 21 may be formed to have a pointed peak. By forming the addendum portion 21 to have the pointed peak, a pressure force per unit area when the addendum potion 21 contacts a surface of the work piece 10 is enhanced. Thus, the addendum portion 21 securely thrusts into, or presses into the surface of the work piece to prevent a deviation of the position of the addendum portion 21 of the die 20 relative to the surface of the work piece 10. Further, when the addendum portion 21 comes in contact the surface of the work piece 10 while rotating, normally, a corner portion of the addendum portion 21 at a front side in a rotational direction contacts the work piece 10 first. Namely, the addendum portion 21 contacts the surface of the work piece 10 at a position deviated to the forward side in the rotational direction relative to a center position of a tooth thickness direction of a tooth 22 of the die 20. When a tooth thickness of the addendum portion 21 is greater, the deviation of the contact position of the addendum portion 21 relative to the center position of the tooth thickness direction of the tooth 22 may be excessively increased. As a result, the possibility that the addendum portion 21 contacts a portion of the surface of the work piece 10 different from the indentation 11 formed previously particularly by the addendum portion 21 is increased.

In order to avoid the foregoing possibilities, according to the die 20 of the embodiments, a degree of the second pressure angle $\alpha 2$ is determined to be greater for reducing a thickness of the addendum portion 21. The base pitch P0' of the die 20 is predetermined as the foregoing. Thus, a distance (interval) between the adjacent teeth is approximately predetermined. Further, because a tooth depth of the gear W is predetermined, a tooth depth of the die 20 is determined to be a predetermined value. Increasing the degree of the second pressure angle $\alpha 2$ under the foregoing conditions connotes that a degree of an inclination (slant) of the tooth on the die reference circle C22 is reduced. Thus, the closer to the addendum portion 21, a tooth flank comes to be closer to the center of the tooth thickness. In other words, when the degree of the second pressure angle $\alpha 2$ is increased, a thickness of a tip end of the tooth 22 is reduced.

FIG. 1 schematically shows the second pressure angle $\alpha 2$ of the die 20 and the first pressure angle $\alpha 1$ of the gear W, which are tangent to a rolling rack 30 on the reference circles (C11, C22), respectively. FIG. 1 further shows a first pitch circle Cp10 of the work piece 10 having a radius rp10, and a second pitch circle Cp20 of the die 20 having a radius rp20. The first pitch circle Cp10 and the second pitch circle Cp20 are tangent to each other on a pitch point $p_0$ on a line of action $L_0$. A pressure angle formed by the pitch point $p_0$ is defined as a working pressure angle $\alpha w_0$. The working pressure angle $\alpha w_0$ differs from the first pressure angle $\alpha 1$ on the gear reference circle C11, and from the second pressure angle $\alpha 2$ on the die reference circle C22.

FIG. 1 further illustrates a base circle C10 of the gear W, and a base circle C20 of the die 20. The gear reference circle C11 is concentric with the base circle $\alpha 10$ of the gear W and the first pitch circle Cp10. In the exemplary embodiment illustrated in FIG. 1, the radius r1 of the gear reference circle C11 is greater than the radius rp10 of the first pitch circle Cp10. Further, the die reference circle C22 is concentric with the base circle C20 of the die and the second pitch circle Cp20. In the exemplary embodiment illustrated in FIG. 1, the radius r2 of the die reference circle C22 is less than the radius rp20 of the second pitch circle Cp20.

There is a limit for increasing the second pressure angle $\alpha 2$ of the die 20. That is, when the degree of the second pressure angle $\alpha 2$ is excessively increased, a tooth flank provided at a driving side in a rotational direction, and a tooth flank provided at a driven side in the rotational direction, cross each other in a state where necessary level of tooth depth is not ensured. Thus, the degree of the second pressure angle $\alpha 2$ is determined to be the maximum when a crossing point of the tooth flank provided at a driving side in a rotational direction and the tooth flank provided at a driven side in the rotational direction is positioned on an addendum circle.

According to known form rolling methods, an addendum pitch has not been considered in regard to designing dies. It is assumed that drawbacks in a manufacturing process have been compromised as long as a final product (i.e., gear) is obtained because a form rolling method applies a large degree of plastic deformation to a blank of a work piece. According to the construction of the embodiments, it is intended to solve the root problem of the form rolling process. According to the method of the embodiments, gears formed by form rolling in various configurations and dimensions are formed with high precision and excellent mechanical characteristics. Further, according to the construction of the embodiments, because the work piece is sufficiently supported by a freely rotatable support and a pressing force applied to the die is reduced, a structure of a manufacturing device is simplified and manufacturing costs is reduced.

The form rolling method of the embodiments is applicable to the involute gears including a spur gear and a helical gear. When the involute gear includes a helix angle $\beta$, a transverse module mt is applied instead of the module m and a transverse pressure angle at is applied (i.e., the case where the helical gear is applied as the involute gear) instead of the pressure angle α for attaining effects and advantages similar to the case where the spur gear is applied as the involute gear. In those circumstances, a base pitch P is shown as follows.

$$P=\pi\cdot mt\cdot\cos\alpha t \quad [7]$$

Here, the following equations are established: mt=m/cos β, tan αt=tan α/cos β

According to the form rolling method of the embodiments, by setting the helix angle β as a parameter to satisfy the equation 2, helical gears can be manufactured.

The form rolling method for forming the involute gear according to the embodiments is applicable to a manufacturing process for manufacturing involute gears applicable to any parts.

According to the embodiments, the form rolling method for an involute gear includes a work piece 10 including the cylindrical outer peripheral surface having a predetermined radius, and a round die 20 with an involute tooth profile including an addendum pitch corresponding to a pitch defined by dividing a length of an outer circumference of the work piece 10 by number of teeth of the involute gear. The round die 20 is pressed to the work piece 10 while rotating when form rolling the involuete gear.

According to the construction of the embodiments, the work piece 10 including the cylindrical outer peripheral surface having the predetermined radius and the round die 20 with the involute tooth profile including the addendum pitch corresponding to the pitch defined by dividing the length of the outer circumference of the work piece by the number of teeth of the involute gear are applied, and the work piece 10 and the round die 20 are pressed to each other while rotating the round die 20. According to the foregoing constructions, the addendum portion 21 of the round die 20 contacts a position on an outer peripheral surface of the work piece 10, the position being in conformity with a pitch of a desired tooth profile to be formed on the outer peripheral surface of the work piece 10 at an initial stage of processing the work piece 10 by the form rolling, and the indentation 11 is gradually formed to be deeper at the position where the addendum portion 21 of the round die 20 contacts. The indentation 11 formed in the foregoing manner serves as a guide groove when another gear tooth of the round die 20 contacts another position on the outer peripheral surface of the work piece 10 consecutively thereafter. Thus, provided that another tooth addendum portion of the gear tooth of the round die 20 contacts a position slightly different from an expected position, a configuration of the indentation 11 is stabilized. The position of the indentation 11 that the die 20 forms on the work piece 10 first is critical. By using the method disclosed here focusing on this critical point, an involute gear with an accurate configuration is formed by the form rolling with high operational efficiency using a round die.

According to the embodiments, the tooth profile of the round die 20 includes a pressure angle greater than a pressure angle of the involute gear.

In order to appropriately mesh involute gears, each gear satisfies conditions defined in the equation 1. According to the construction of the embodiments, the second pressure angle α2 of the round die 20 is determined to be greater than the first pressure angle α1 of the involute gear which is to be formed by the form rolling while satisfying the conditions specified in the equation 1. Thus, a configuration of the addendum portion of the round die 20 is assumed to be slightly sharper compared to a configuration of an addendum portion of known dies. Particularly, a dimension of a top land of the gear tooth is reduced according to the construction of the embodiments.

According to the construction of the embodiments, because the configuration of the involute gear to be produced is predetermined, a configuration of the tooth profile of the round die 20 which is configured to engage with the involute gear to be formed is limited within a predetermined range. Further, a tooth depth of the involute gear to be formed and a tooth depth of the round die 20 are substantially the same. Thus, a tooth of the round die 20 having a greater pressure angle (i.e., the pressure angle α2) includes a tooth flank at a driving side in a rotational direction and a tooth flank at a driven side in the rotational direction which are arranged to be closer at an addendum portion thereof, and thus a configuration of an addendum portion of the gear is sharpened when viewing the produced gear in a direction along a rotational axis.

By applying the round die 20 having an addendum portion with shaper configuration, a pressing load relative to the work piece 10 per contacting unit dimension is increased. Thus, the indentation 11 can be securely formed on an optimum position on a surface of the work piece 10 at a thrust at an initial stage of the form rolling. Consequently, when the indentation 11 receives a press forming for the second time, the tooth of the round die 20 is readily guided into the indentation 11 to perform the second pressing more accurately. Further, according to the construction of the embodiments, because the pressing load of the die 20 (die) is reduced as a whole, a gear is readily produced with a form rolling apparatus which is smaller in size and inferior in processing performance, thus reducing manufacturing costs. Further, by increasing the second pressure angle α2 of the round die 20, a tooth thickness of a dedendum portion is assumed to be greater relative to a tooth thickness of an addendum portion. According to the foregoing construction, an external force applied to the addendum portion is likely to be spread to the dedendum portion to reduce stress concentration at the addendum portion or at an entire range of the tooth. Accordingly, a crack of the addendum portion and a fatigue fracture of the dedendum portion are restrained to enhance a life span of the round die 20.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A form rolling method for involute gears, comprising:

providing a work piece including a cylindrical outer peripheral surface having a predetermined radius;

determining a first pitch by dividing a length of an outer circumference of the work piece prior to form rolling by a number of teeth of an involute gear to be formed from the work piece;

determining a first pressure angle of each tooth of the involute gear;

determining a reference pressure angle corresponding to a crossing point of a tooth flank on a driving side in a rotational direction of a reference die and a tooth flank on a driven side in the rotational direction of the reference die;

selecting a round die including:

a single uniform involute tooth profile for each tooth of the round die provided with a second pressure angle that is greater than the first pressure angle and less than or equal to the reference pressure angle, and an addendum pitch that is equal to the first pitch that was determined; and pressing the round die to the work piece while rotating the round die to form the involute gear from the work piece.

2. The form rolling method for involute gears according to claim 1, wherein pressing the round die to the work piece includes initially pressing the work piece to form uniform indentations having an indentation pitch equal to the addendum pitch of the round die.

3. The form rolling method for involute gears according to claim 1, wherein prior to selecting the round die the form rolling method further comprises:

determining a base pitch of the involute gear based on a radius of a first reference circle and a first pressure angle of the involute gear to be formed from the work piece, wherein the radius of the first reference circle is greater that a radius of a first pitch circle of the involute gear.

4. The form rolling method for involute gears according to claim 3, wherein selecting the round die further comprises:

determining a second pitch based on the base pitch of the involute gear;

determining the second pressure angle based on the second pitch and the reference pressure angle; and selecting the round die to be a round die with a base pitch equal to the second pitch and a pressure angle equal to the second pressure angle.

5. The form rolling method for involute gears according to claim 4, wherein the base pitch of the involute gear is equal to the base pitch of the round die.

* * * * *